United States Patent [19]

Hyde

[11] 4,201,543

[45] May 6, 1980

[54] HOT BLAST STOVE BREAST WALL

[75] Inventor: Jack Hyde, Pittsburgh, Pa.

[73] Assignee: Koppers Company, Inc., Pittsburgh, Pa.

[21] Appl. No.: 928,244

[22] Filed: Jul. 26, 1978

[51] Int. Cl.[2] ..... C21B 9/00

[52] U.S. Cl. ..... 432/217; 432/218

[58] Field of Search ..... 432/214, 216, 217, 218

[56] References Cited

U.S. PATENT DOCUMENTS

| | | | |
|---|---|---|---|
| 3,488,041 | 1/1970 | Powell et al. | 432/217 |
| 3,806,313 | 4/1974 | Van Laar et al. | 432/217 |

*Primary Examiner*—John J. Camby

*Attorney, Agent, or Firm*—R. Lawrence Sahr

[57] ABSTRACT

A breast wall construction of a blast furnace hot blast stove includes a free-moving vertical arch composed of reverse wedge interlocking refractory shapes which form a monolithic unit upon differential heat expansion of the breast wall when the blast stove is operating in the on-gas mode.

10 Claims, 5 Drawing Figures

HOT BLAST STOVE BREAST WALL

BACKGROUND OF THE INVENTION

1. Field of the Invention

The invention is related generally to blast furnace equipment as utilized in the manufacture of steel and, more specifically, to the construction of side-combustion hot blast stoves used to preheat the blast before introduction of that blast into a blast furnace.

2. Background of the Prior Art

The conventional construction and operation of side-combustion hot blast stoves is aptly set forth in "The Making, Shaping and Treating of Steel", 1971 edition, published by U.S. Steel Corporation, at pages 439–441. Included in this treatise are general diagrams of conventional hot blast stove design and construction.

The function of the breast wall in a hot blast stove is to separate and insulate the side-combustion chamber from the refractory checker chamber. The breast wall must be structurally sound to support the side-combustion chamber so as to maintain the refractory checkers free of lateral stress. In addition, the breast wall is required to be gas tight to prevent lateral leakage back and forth between the combustion chamber and the checker chamber.

Older designs of checkers utilized rather rugged thick sections for the checker cross section. This thick-section type of design necessarily reduced the overall area of refractory available in the checker chamber for heat transfer. However, the thick sections were deemed necessary to counteract the lateral forces directed on the checkers from the expansion of the breast wall when the hot blast stove was in the on-gas mode and combustion was taking place in the combustion chamber. The combustion produces heat which causes the face of the breast wall adjacent the combustion chamber to expand at a rate greater than the expansion of the opposite wall and the adjoining checker chamber. This expansion tends to produce a lateral crushing force on the checker brick in the checker chamber.

A further problem caused by the differential expansion of the breast wall develops from the fact that conventional breast walls are constructed of individual refractory shapes or brick. When the differential expansion takes place, the joints between these brick open up producing passageway through which hot gases can seep, thus derogating from the designed gas passage upwards through the combustion chamber to the dome, then downward through the checker chamber. Such gas seepage provokes localized hot spots at random points in the checker chamber adjacent the breast wall. These hot spots create rapid deterioration of the checker brick at those points and also tend to produce uneven heating, thus unbalanced cooling stresses in the checker brick when the hot blast stove is switched to the on-blast mode and the combustion heat is regenerated. In addition, highly localized overheating can occur on the metallic support structures related to the checker chamber resulting in distortion and/or failure thereof.

The design of the checker chamber has progressed, in recent years, in the direction of greater efficiency of heat transfer. Theoretically, it is well known that the more surface area available to preheat the cold gas being drawn through those checkers, the higher the average heat of the hot blast output from the stove. If the hot blast from the stove can be maintained at a higher average temperature, i.e., less of an amount of cold blast being required in the mixture to produce a uniform temperature, then the more efficient can be the operation of the blast furnace to which the hotter blast is being fed.

Practically, the increases in surface area within the checker chamber are limited by the requirement that the structural integrity of the checker brick must be maintained. It is a well-known axiom that the greater amount of surface area exposed in a checker brick, the thinner the wall sections of the checker must be. But this axiom must be limited in practice by the physical limitations applicable to the checkers. Checker brick wall or section thickness cannot be reduced below certain limitations because of the lateral crush forces that are imposed on the checker brick in operation in the checker chamber. Thus, in known design techniques the maximum heat transfer area available within a checker chamber of a particular size is limited by the lateral stresses that will be imposed by the differential expansion of the breast wall.

Vertical arch forms for hot blast stove breast walls have long ago been tried as such forms appeared to provide a rather simplified structure which was relatively less costly to construct and maintain as well as providing space economy. However, it was found that the conventional arch pattern, formed with regular key-shaped refractory brick, increased beyond tolerable limits the lateral stress imposed onto the checker brick within the checker chamber. Rapid deterioration of the checker brick resulted with a commensurate reduction in the ability of the hot blast stove to preheat the blast. Premature rebuilds of the hot blast stoves were required which were costly. Thus, the use of breast walls formed by a conventional vertical arch was rapidly abandoned in favor of forms including a modified arch similar to those shown in the above reference to "The Making, Shaping and Treating of Steel".

The main object of the present invention is to provide for the simplicity and economy of a vertical arch in hot blast stove breast wall construction, while substantially eliminating the lateral crush stress on the checker brick in the checker chamber, when the hot blast stove is in the on-gas mode, as caused by the differential expansion of the breast wall. Another object of the invention is to substantially reduce gas passage from the combustion chamber through the breast wall into the checker chamber when the hot blast stove is in the on-gas mode as well as the elimination of short circuiting of air flowing from the checker chamber to the combustion chamber during the on-blast mode.

BRIEF DESCRIPTION OF THE INVENTION

In a side-combustion style hot blast stove, as is in conventional use in conjunction with blast furnace operations, the breast wall, which serves to separate the side combustion chamber from the checker chamber or regenerator, is constructed in the form of a vertical arch, generally equivalent in radius to the radius of the hot blast stove. The material used in the construction is a refractory, equivalent in characteristics to that conventionally utilized in breast wall construction. The vertical arch is composed of refractory shapes designed to interlock on all four adjoining sides, preferably along the full length of each side, with adjacent similar refractory shapes. Each of the refractory shapes has a characteristic reverse key form, that is, it includes tapered vertical sides arranged such that the vertical sides tend to converge toward that face of the refractory shape which forms an arc segment of the larger radius arc of the horizontal arch, and tend to diverge toward that face of the refractory shape which forms an arc segment of the smaller radius arc of the horizontal arch. The refractory shapes are laid up in conventional manner, generally with tight mortar joints. Each of the courses of refractory shapes is arranged such that the separation between the individual shapes are staggered to be about the midpoint of the refractory shapes of the adjacent courses below and above, respectively, as is common practice in masonry construction.

The breast wall adjoins the shell wall of the hot blast stove at the points of the intersections of the regular arcs of both the breast wall and the shell wall. There may be an expansion joint interposed at both of the points at which the breast wall intersects the arc of the shell such that the arc length of the breast wall can increase and decrease without distorting the shell. The adjunctures of the breast wall with the shell wall may be arranged such that the breast wall is prevented from moving laterally, in a horizontal direction, in relation to said shell wall.

For a further understanding of the invention and features thereof, reference may be made to the following detailed description of the preferred embodiment of that invention and the drawing figures which illustrate that preferred embodiment, as well as the appended claims.

DETAILED DESCRIPTION

Figure 1:
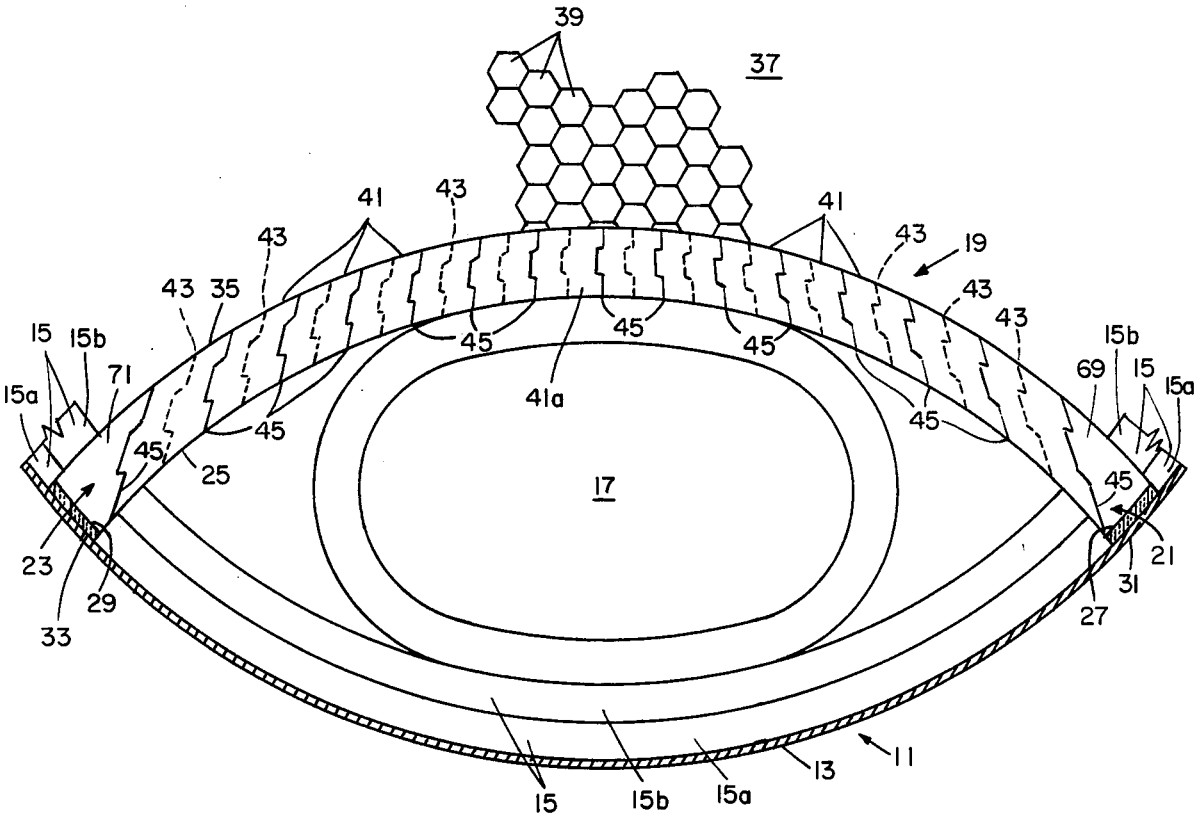
FIG. 1 is a schematic plan view of a section of a hot blast stove illustrating a side combustion chamber, a breast wall and a portion of the shell wall intersecting the breast wall at two points, all in accordance with the present invention.

Referring to FIG. 1, there is illustrated a section of a hot blast stove, generally designated by the numeral 11. The hot blast stove section 11 includes a portion of the steel shell 13, which surrounds the hot blast stove, and a shell wall consisting of a refractory section **15*b* and an insulation section 15*a***.

Also included in the hot blast stove section 11 are a side combustion chamber 17 and a breast wall, generally designated by the numeral 19. The combustion chamber 17 is constructed of a refractory material of sufficient character to withstand the elevated temperatures of combustion developed in the operation thereof in the on-gas mode.

As shown in FIG. 1, the breast wall 19 forms a vertical arch, that is, the projection of the arc of the arch extends vertically. It will be noted from referring to FIG. 1 that the portion of the shell wall 15 that is adjacent to the combustion chamber 17 extends to intersect the arc of the breast wall 19 at ends 21, 23 of the breast wall 19 such that both the insulation section **15*a* and the refractory section 15*b* abut the side 25 of the breast wall 19 which is formed by the smaller radius of the breast wall 19 at each of those ends 21, 23. The steel shell 13, on the other hand, extends past the end faces 27, 29 of the breast wall 19**.

The steel shell 13 is sealably separated from the end faces 27, 29 by expansion joints 31, 33 which can be formed of any suitable elevated temperature material which remains flexible, for example, asbestos millboard.

It will further be noted from referring to FIG. 1 that the shell wall 15 extends from both ends 21, 23 of the breast wall 19 and abuts the breast wall 19 on the side 35 which is formed by the larger radius of the breast wall 19 adjacent the checker chamber, generally designated by the numeral 37, a portion of which is illustrated in FIG. 1.

The checker chamber 37 is composed of checker brick 39, preferably of the type disclosed in U.S. Pat. No. 3,488,041. Other types of checker brick may be used, the major criterion in selection being a maximmumization of the surface area available for heat transfer.

The breast wall 19 is composed of refractory shapes, generally designated by the numeral 41. The refractory shapes 41 are laid up in a conventional manner, alternating the separations, or joints, of each course to fall about midpoint of the joints separating the refractory shape 41 of the vertically next adjacent courses. Referring to FIG. 1, the joints 43, shown in phantom outline, depict the arrangement of the refractory shapes 41 in the course immediately beneath the course shown in solid lines. The joints 45 of the course of refractory shapes 41, as shown by solid lines in FIG. 1, fall about midpoint between the joints 43. The refractory shapes 41 are laid up using conventional tight mortar joints to separate each refractory shape 41 from the next horizontally adjacent refractory shape 41, as well as to separate each course of refractory shapes 41 from the next vertically adjacent course of refractory shapes 41.

Figure 2:
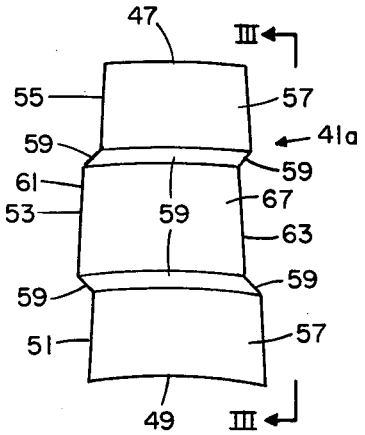
FIG. 2 is a plan view of a typical refractory shape in accordance with the invention.
Figure 3:
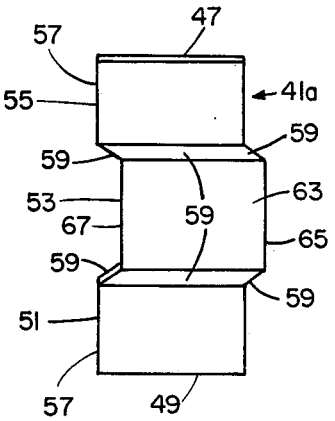
FIG. 3 is a side view of the refractory shape of FIG. 2 as viewed from III—III.
Figure 4:
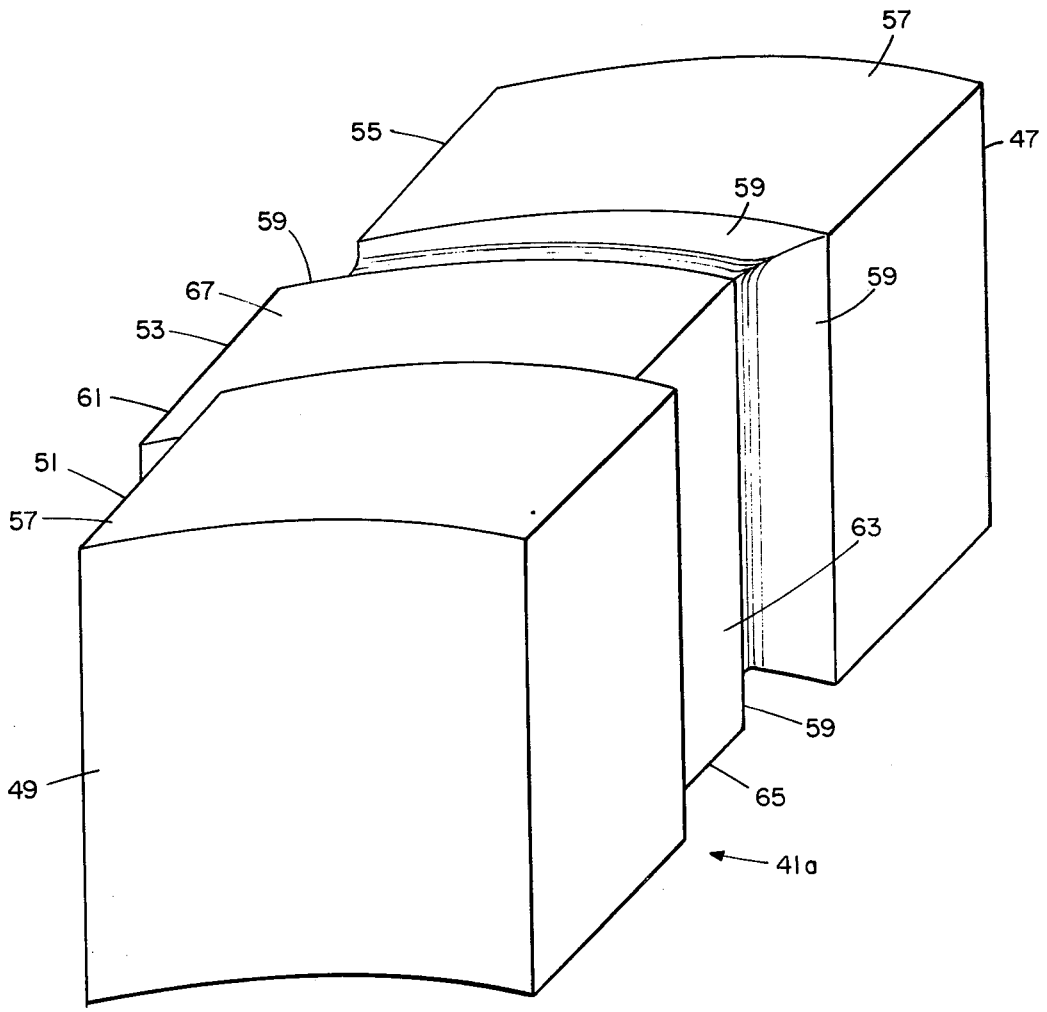
FIG. 4 is an orthographic projection of the refractory shape of FIG. 2, enlarged in proportion thereto.

In the breast wall 19 a typical refractory shape is designated by the numeral **41*a* and is shown enlarged in FIGS. 2, 3 and 4. The general design of all the refractory shapes 41 follows the pattern of shape 41*a*** and is complementary thereto in a manner which will be readily comprehended by one skilled in the art.

As is suggested in FIG. 1, the steel shell 13 is continuous, surrounding the hot blast stove in the form of a vertical cylinder. The shell wall 15 extending from the side 35 of the breast wall 19, from end 21 to end 23 of the breast wall 19, is also continuous and forms the checker chamber 37.

Figure 5:
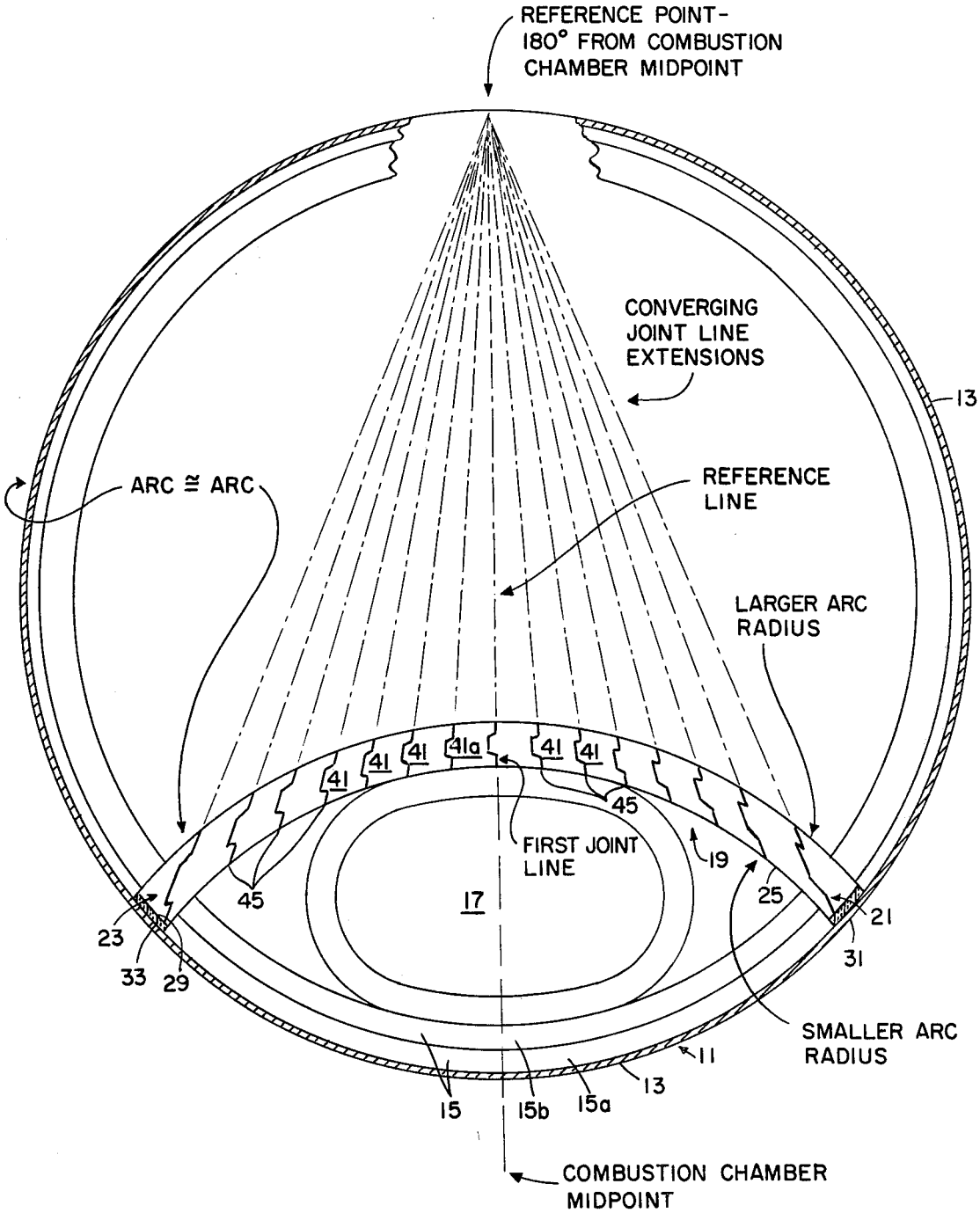
FIG. 5 is a schematic plan view of a hot blast stove illustrating the design of the refractory shapes of the breast wall in accordance with the present invention.

In designing the refractory shapes 41 for the first course, and each alternate course therefrom, for the breast wall 19, a reference point is first located on the steel shell 13. Referring to FIG. 5, the reference point is 180°, or one half of the circumference of the steel shell 13, away from a point on the steel shell 13 adjacent to the midpoint of the combustion chamber 17. From that reference point, a first joint line is located which falls on a reference line which may be drawn from the reference point to the point on the steel shell 13 adjacent to the midpoint of the combustion chamber 17, through the center of the hot blast stove. In FIG. 1 that first joint line is equivalent to the joint 45 which forms the right edge of refractory shape **41*a*. From the reference line, upon which falls the first joint line, additional joint lines are established, the extension of each passing through the reference point and each having an angle separating it from the next adjacent joint line, or lines, which are generally equal to the angle separating each of the other joint lines for the next adjacent joint line or lines. Each of the thus established joint lines is extended to pass through the breast wall 19. Each of the joints 45 falls on a joint line. The angle which separates succeeding joint lines is set to conform to convenient sizes for manufacturing the refractory shapes 41, such sizes which are well known to those skilled in the art. Because all of the joint lines converge and pass through a single point, the reference point, and all of the joints 45 between the refractory shapes 41 fall on the joint lines, the side edges of each refractory shape 41 are tapered, tending to converge toward the checker chamber and beyond it to intersect the reference point on the steel shell 13 opposite the breast wall 19, developing the characteristic reverse key form. Thus, the face 47 which forms part of side 35 of the breast wall 19 spans a shorter distance, from edge to edge of a refractory shape 41, than does the face 49 which forms part of side 25 of the breast wall 19 as measured on lines approaching the perpendicular from edge to edge (these lines can never be perpendicular to both edges, as those edges are not parallel). For the course of refractory shapes 41 vertically next adjacent to the first course, and for each alternate course of refractory shapes therefrom, instead of the first joint line falling on the reference line, two first joint lines are established, utilizing the same angle that is used to separate joint lines in the first course of refractory shapes 41. These two first joint lines are positioned so that the reference line bisects the angle therebetween. From these first two joint lines, the other joint lines are established in the same manner as described for the first course of refractory shapes 41. Likewise, the same commentary concerning the taper of the refractory shapes 41 applies equally to all courses of refractory shapes 41**.

The next step in designing the refractory shapes 41 of the breast wall 19 is to establish a first and second arc line, tracking the arc of the breast wall 19 and dividing the thickness of the breast wall 19 into three parts of approximately equal thickness. The first part, adjacent to the combustion chamber, will be referred to as the combustion portion 51. The second part, adjacent to the combustion portion 51, will be referred to as the midportion 53. The third part, adjacent to the checker chamber and the midportion 53, will be referred to as the checker portion 55. Those sections of the first and second arc lines which are applicable to typical refractory shape 41*a* are approximated in FIGS. 2, 3 and 4 as the dividing lines between the combustion portion 51, the midportion 53, and the checker portion 55. The extension of those first and second arc line sections are readily visualized on FIG. 1 by visually following the arrangement of alternating joints 45, 53 from end 21 to end 23 of the breast wall 19.

The typical refractory shape 41*a*, illustrated in FIGS. 2, 3 and 4, is susceptible to the approximate general description of a rectangular box with an offset center section, tapered sides and curved ends. FIG. 2 is a plan view, or a view from directly above, looking down thereon, of the typical refractory shape 41*a*. As seen in FIG. 2, the midportion 53 is offset to the left from the combustion 51 and the checker portion 55. The midportion 53 is also depressed below the top surface plane 57 of the combustion portion 51 and the checker portion 55. The midportion 53 is surface connected to the combustion portion 51 and the checker portion on all side surfaces by a draft transition 59 which is in the form of a fillet, tapering adjacent adjoining surfaces to abut. The face surfaces of the midportion 53 are parallel to the corresponding side surfaces of the combustion portion 51 and checker portion 55.

The offset to the left of the midportion 51 results in a left side projection 61 and a right side recess 63 of the typical refractory shape 41*a*, as illustrated in FIG. 2. As illustrated in FIG. 3, the midportion 53 is also offset downward, or to the right, in that side or elevation view of the typical refractory shape 41*a*. This downward offset results in a bottom side projection 65 and a top side recess 67.

As shown in FIGS. 2 and 4, face 49 has a concave curve which corresponds in arc characteristics to the side 25 of the breast wall 19. Similarly, face 47 has a convex curve which corresponds in arc characteristics to the side 35 of the breast wall 19. Both faces 47 and 49 form a section of walls 35 and 25, respectively, when the typical refractory shape 41*a* is positioned in place in the breast wall 19, as shown in FIG. 1. Alternately, the faces 47 and 49 could be straight, forming straight surface segments which, taken together, form an arc.

The peripheral left side projection 61, bottom side projection 65, right side recess 63 and top side recess 67, tracing the side periphery of the typical refractory shape 41*a*, as viewed in FIG. 4, form a tongue-and-groove type interlock means operable with the next adjacent refractory shapes 41, both horizontally and vertically. Horizontally, in any given course of refractory shapes 41, the left side projection 61 of a typical refractory shape 41*a* fits into the right side recess 63 of the next adjacent refractory shape 41 to the left; likewise, the right side recess 63 of that typical refractory shape 41*a* receives the left side projection 61 of the next adjacent refractory shape 41 to the right. The projections and recesses are complementary; however, as mentioned before, a tight mortar joint is used therebetween such that the projections and recesses do not actually touch each other. This tight mortar joint ensures that the breast wall 19 will be gas-tight in operation.

Vertically, between courses of refractory shapes 41, the bottom side projection 65 of a typical refractory shape 41*a* fits into the top side recesses 67 of the next adjacent refractory shapes 41 below; likewise, the top side recess 63 of that typical refractory shape 41*a* receives the bottom side projections 65 of the next adjacent refractory shapes 41 above. Here, again, the actual joints are tight mortar joints to prevent gas leakage.

Referring to FIG. 1, it will be noted that the ends 21, 23 of the breast wall 19 are composed of end refractory shapes 69, 71. These end refractory shapes 69, 71 differ from the refractory shapes 41 that are used to compose the breast wall 19 in only one significant way, that is, in that the end refractory shapes 69, 71 have cropped ends which are squared off to meet the expansion joints 31, 33, forming the end faces 27, 29 of the breast wall 19.

In operation in the hot blast stove on-combustion mode, combustion occurs vertically up through the combustion chamber 17, concentrating heat on that portion of the side 25 of the breast wall 19 which is adjacent to the combustion chamber 17. The side 25, being differentially hotter in this location than the balance of the breast wall, tends to expand the refractory shapes, both in a direction along the arc of the breast wall 19 as well as toward the checker chamber 37. This expansion tends to force the whole breast wall 19 to bulge toward the checker chamber 37. However, the interlock means, as previously described, prevents any single refractory shape 41 from moving out of position in respect to all adjacent refractory shapes 41, both horizontal and vertical. Therefore, all of the refractory shapes 41 of the breast wall 19 must move with each other. The bulge effect on the breast wall 19 is such that it tends to increase the radius of the arc of the breast wall 19. This tendency to increase radius produces pressure on the joints 43, 45 due to their tapered design, forcing the refractory shapes 41 to take on monolithic structure characteristics such that the breast wall 19 can only move as a single unit. Since the breast wall 19 is wedged between the sections 15*a* and 15*b* of the shell wall 15, about the ends 21, 23 of the breast wall 19, the breast wall 19 is prevented from moving as a unit. Increased combustion heat, producing increased differential temperatures and increased expansion of side 25, merely serves to increase the compressive force on joints 43, 45.

The end result of the present invention is to produce a checker chamber 37 substantially free of lateral crushing forces, thus allowing the design of checker brick 39 with significantly greater area for heat transfer and thinner refractory cross sections.

According to the provisions of the patent statutes, the principle of the present invention has been explained and the preferred construction and mode of operation have been illustrated and described in what is now considered to represent its best embodiment. However, it is to be understood that, within the scope of the appended claims, the invention may be practiced otherwise than is specifically illustrated and described.

What is claimed is:

1. In a side combustion chamber hot blast stove, used in conjunction with a blast furnace in steel manufacturing operation, a breast wall comprising a masonary refractory construction of multiple vertical courses of refractory shapes arranged in a vertical arch, said refractory shapes having means for interlocking and being interlocked, along adjoining sides, in a complementary manner such as to prevent individual movement in relation to each other, each of said refractory shapes having a characteristic reverse key form, said refractory shapes being arranged in said breast wall, said reverse key form tending to converge toward that side of the said breast wall which forms the larger arc radius of said horizontal arch, said breast wall adjoining the shell wall of said hot blast stove at the points of intersection of the arc of said shell wall with the arc of said vertical arch.

2. The invention described in claim 1 wherein said points of intersection of the said arc of said shell wall with the said arc of said vertical arch are formed of elevated temperature service expansion joints, the arc length of said arc of said horizontal arch tending to increase and decrease with temperature changes without distorting said shell wall.

3. The invention described in claim 1 wherein said adjunctures of said breast wall with said shell wall are arranged to prevent said breast wall from moving laterally, in a horizontal direction, in relation to said shell wall.

4. The invention described in claim 1 wherein said masonry refractory construction includes tight mortar joints between each of said refractory shapes.

5. The invention described in claim 1 wherein said means for interlocking is located along the full length of each adjoining side of said refractory shapes.

6. The invention described in claim 1 wherein said interlock means is of the tongue-and-groove type.

7. The invention described in claim 6 wherein said interlock means is of the tongue-and-groove type.

8. The invention described in claim 6 wherein said tongue-and-groove type interlock means includes draft transitions in all adjoining side surfaces of said interlock means which abut between said refractory shapes.

9. The invention described in claim 1 wherein said reverse key shape forms as arranged in said breast wall all tend to converge on a single point, located adjacent said skin wall, at the opposite side of said hot blast stove from the location of said side combustion chamber.

10. The invention described in claim 1 wherein said arc of said horizontal arch is about equal in radius to the radius of said arc of said shell wall.

* * * * *